US008833131B2

(12) United States Patent
Reiter et al.

(10) Patent No.: US 8,833,131 B2
(45) Date of Patent: Sep. 16, 2014

(54) BENDING MACHINE COMPRISING A CAVITY FOR A FOOT SPACE

(75) Inventors: Thomas Reiter, St. Marienkirchen a.d. Polsenz (AT); Hermann Allerstorfer, Kirchberg a.d. Donau (AT)

(73) Assignee: Trumpf Maschinen Austria GmbH & Co. KG (AT)

( * ) Notice: Subject to any disclaimer, the term of this patent is extended or adjusted under 35 U.S.C. 154(b) by 1300 days.

(21) Appl. No.: 12/597,591

(22) PCT Filed: Apr. 29, 2008

(86) PCT No.: PCT/AT2008/000155

§ 371 (c)(1),
(2), (4) Date: Oct. 26, 2009

(87) PCT Pub. No.: WO2008/131471

PCT Pub. Date: Nov. 6, 2008

(65) Prior Publication Data

US 2011/0138869 A1 Jun. 16, 2011

(30) Foreign Application Priority Data

Apr. 30, 2007 (AT) ..... A 672/2007

(51) Int. Cl.
*B21D 5/02* (2006.01)
*B30B 15/04* (2006.01)
*B21D 5/00* (2006.01)

(52) U.S. Cl.
CPC . *B21D 5/02* (2013.01); *B30B 15/04* (2013.01); *B21D 5/002* (2013.01); *B21D 5/00* (2013.01)
USPC ..... 72/389.3; 72/31.1; 72/455

(58) Field of Classification Search
USPC ..... 72/31.1, 37, 165, 310, 389.1–389.4, 72/443, 455, 461; 74/564
See application file for complete search history.

(56) References Cited

U.S. PATENT DOCUMENTS 2,848,034 A * 8/1958 Ernst ..... 72/28.1
3,032,688 A * 5/1962 Spira ..... 315/272

(Continued)

FOREIGN PATENT DOCUMENTS

DE 1849917 U1 4/1962
DE 1903861 A1 9/1969

(Continued)

OTHER PUBLICATIONS

Stanley, Lynn. "Ther Perfect Fit: Fabricator matches the right Machine to the job for Optimal Efficiency" FFJournal, Mar. 2013: 26-28. Web. <http://www.ffjournal.net>.*

(Continued)

*Primary Examiner* — Shelley Self
*Assistant Examiner* — Leonel Vasquez
(74) *Attorney, Agent, or Firm* — Lerner, David, Littenberg, Krumholz & Mentlik, LLP

(57) ABSTRACT

The invention describes a bending press, in particular a press brake, with a stationary bottom press beam or press table and a top press beam which can be displaced relative to the bottom press beam or press table by means of a displacement drive. The bottom press beam or press table or a machine table or machine frame supporting the bottom press beam has at least one recess affording foot room for an operator on a control side of the bending press.

27 Claims, 3 Drawing Sheets

(56) References Cited

U.S. PATENT DOCUMENTS

| | | | | | |
|---|---|---|---|---|---|
| 3,633,395 | A | * | 1/1972 | Anderson | 72/21.3 |
| 3,646,883 | A | * | 3/1972 | Provi | 100/342 |
| 3,715,907 | A | * | 2/1973 | Hamada | 72/419 |
| 3,855,840 | A | * | 12/1974 | Kawano | 72/418 |
| 3,884,061 | A | * | 5/1975 | Westby | 72/38 |
| 4,074,350 | A | * | 2/1978 | Roch et al. | 700/180 |
| 4,114,418 | A | * | 9/1978 | Jarman | 72/386 |
| 4,341,104 | A | * | 7/1982 | Jarman | 72/389.3 |
| 5,174,223 | A | * | 12/1992 | Nagy et al. | 108/50.01 |
| 5,385,322 | A | * | 1/1995 | Kim et al. | 248/118 |
| 5,836,196 | A | | 11/1998 | Smith | |
| 5,863,282 | A | * | 1/1999 | Moossun | 482/148 |
| 6,152,028 | A | * | 11/2000 | Skyllermark | 100/214 |
| 7,908,978 | B1 | * | 3/2011 | Pelton | 108/50.02 |
| 2011/0252859 | A1 | * | 10/2011 | Burgstaller et al. | 72/389.3 |

FOREIGN PATENT DOCUMENTS

| | | | | | |
|---|---|---|---|---|---|
| DE | 2343674 | | * | 8/1973 | |
| DE | 3023511 | A1 | | 1/1982 | |
| DE | 19809704 | A1 | | 9/1999 | |
| FR | 590212 | A | | 6/1925 | |
| JP | 55130340 | A | | 10/1980 | |
| JP | 59199200 | A | | 11/1984 | |
| JP | 05069045 | A | * | 3/1993 | B21D 5/02 |
| JP | 2001025823 | A | | 1/2001 | |
| JP | 2001087829 | A | * | 4/2001 | B21D 43/00 |
| JP | 2006061959 | A | * | 3/2006 | |
| WO | 9700158 | A1 | | 1/1997 | |

OTHER PUBLICATIONS

Boschert. Profi 28 Product Brochure Oct. 21, 2010. Web. <http://boschert.de>.*

Safan. E-Brake Ergonomic Product Brochure Nov. 2, 2010. Web. <http://www.safandarley.com>.*

McMillan, Melanie. "TruBend Series 7000 Press Brakes: Compact, Efficient and Ergonomically Enhanced" TRUMPF Inc. Public Relations, May 21, 2009. Web. <http://news.thomasnet.com>.*

International Search Report, PCT/AT2008/000155, dated Sep. 3, 2008.

* cited by examiner

BENDING MACHINE COMPRISING A CAVITY FOR A FOOT SPACE

CROSS REFERENCE TO RELATED APPLICATIONS

The present application is a national phase entry under 35 U.S.C. §371 of International Application No. PCT/AT2008/000155, filed 29 Apr. 2008, the disclosure of which is incorporated by reference, which claims the benefit of Austrian Patent Application No. A 672/2007, filed 30 Apr. 2007.

BACKGROUND OF INVENTION

The invention relates to a bending press, in the form of a press brake.

These days, a large number of bending presses, in particular press brakes, are used to produce bent parts, primarily using bending processes involving free bending, embossing or three-point bending. To enable the often very strong bending forces which need to be applied with-out causing unacceptable deformation of the bending machine, such machines have very solid press beams and press tables, thereby ensuring a high bending accuracy even when working with larger workpieces and bigger sheet thicknesses. To this end, the bottom press beam or press table is usually designed as a continuous solid plate with as high a bending resistance as possible. There are other designs where the bottom press beam or press table has recesses or slots which permit a deformation corresponding to a bending deformation of a top press beam. What all of these designs have in common is that these bending machines or press brakes are designed to be operated from a standing position, whereas the design of the bottom press beam or press table makes operation from a seat position more difficult because there is not enough room for the legs and feet of a user. When operating such a machine from a seated position, physical positions are therefore assumed in which the upper body is inclined far forwards or turned to the side because the legs are turned very far sideways approximately parallel with the front face of the bending press. However, such physical positions are very tiring for the user of the bending press, which means that production efficiency can drop or it is necessary to take breaks more often, thereby reducing the productivity of such a bending press.

BRIEF SUMMARY OF INVENTION

The objective of the invention is to propose a bending press, in particular a press brake, which is ergonomically designed so as to be conducive for operation both from a standing position and seated, and which makes it possible to work without becoming tired.

This objective is achieved by the invention on the basis of a bending press, in particular a press brake, incorporating the characterizing features defined in claim 1. Due to a recess in the bottom press beam or press table or a machine table or machine frame supporting the bottom press beam, an operator of the bending press is able to assume a normal seated position with head, shoulders and arms at the normal operating distance from the bending plane of the bending press extending between the bending tools, thereby resulting in higher production efficiency due to reduced strain. Since the operator becomes less tired, the risk of accidents at work is significantly reduced.

If the recess has a horizontal internal width of at least 500 mm, in particular at least 750 mm, the foot room or leg room is enough to accommodate both of the operator's feet and legs comfortably.

Alternatively, two mutually spaced apart recesses may be provided, each of which has a horizontal internal width of at least 200 mm, in which a case separate foot room or leg room can be provided for each foot or each individual leg, or access is provided via the recesses to a joint foot room lying behind. A support element with a width of between 50 mm and 250 mm may be disposed between the two recesses, which is designed to provide vertical support for the bottom press beam or press table between the recesses, thereby increasing the stiffness compared with a large joined recess.

The recess advantageously has a horizontal depth of at least 250 mm, in particular 450 mm, preferably 600 mm, as measured from the front edge of the recess lying on the operator's side. This depth of recess enables the operator to move the upper body sufficiently close to the working plane of the bending press, and if opting for bigger depths, it will also be possible to change the leg position, for example enabling the operator to stretch out the knee, at least to a certain extent, thereby offering an even better way of preventing fatigue. Another way of enabling the operator to move the upper body close to the bending plane or working plane is for the recess to project by at least 200 mm behind the bending plane of the press beam, likewise achieving a sufficient depth for the foot room.

The vertical internal height of the recess in the middle is advantageously at least 650 mm, preferably 750 mm, thereby ensuring that there is sufficient leg room in terms of height for average leg lengths.

A top delimiting surface of the recess may have a cambered rounded region, in which case the internal height of the recess decreases so that it is shorter at the side edges than in the middle, in which case the recess is also adapted to the reduced height requirement if the legs are shifted to the side. Moreover, a cambered design of the rounded region is conducive to transmitting the pressing forces to the lateral support points if the top delimiting surface of the recess is formed by the bottom face of the press beam.

The recess may also be formed in a different way if the bottom press beam is secured at its ends to side panels of a machine base or a machine frame. A particularly reliable way of dispersing the pressing forces which occur on the bottom press beam is to lay the ends of the press beam in co-operating recesses in the side panels of the machine frame.

Since the working height of the bending press or press brake is higher than that of a normal seated workplace, it is of advantage if a foot rest which is higher than the standing surface of the bending press is provided in the recess. The operator's upper body can be raised to the same height as a standing position by an operator's chair which is raised accordingly and the legs are then supported by the higher foot rest.

In this respect, the foot rest may be height-adjustable particular, and adjustable in terms of its inclination, thereby enabling an adjustment to suit different leg lengths.

Another way of making things easier for the operator is to provide a foot switch in the recess which can be operated by a foot and is connected to a control device of the bending press so that the foot does not have to be moved out of the recess in order to operate the foot switch. Another possible improvement can be achieved if the foot switch can be fixed by means of an adjusting device and a fixing device in different positions inside the recess, in particular on the foot rest in the interior of the recess. An adaptation can easily be made to different foot positions or leg positions due to the fact that the fixing device ensures that the foot switch does not inadvertently shift from its position during use. The adjusting device and the fixing device may also be combined, for example in the form of an adjustment rail, on which the foot switch can be latched in different positions, and fixing may take place by means of a spring-biased element.

Another advantageous embodiment of the bending press which prevents premature tiring of an operator is characterized by the fact that an illuminating foreground light system is provided in front of the bending plane in the workspace between the top press beam and bottom press beam. This ensures that the operator has a good view of the pressing tools disposed in the press beam and whatever workpiece has to be processed. To this end, the foreground light system is preferably disposed in front of and above the top press beam.

It is also of advantage to provide an illuminating background light system behind the working plane in the workspace behind the bottom press beam, in particular on a rear stop system. Particularly if using a rear stop system, it is important for the operator to have good viewing conditions in this region because it is not possible to obtain high dimensional accuracy of the bent parts unless the workpieces to be bent are placed exactly against stop elements of the rear stop system. Equipping a bending press with a foreground light system and background light system significantly reduces premature tiring of the operator due to poor viewing conditions requiring higher concentration.

In order to ensure constant lighting conditions across the working width of a bending press, it is of advantage if the foreground light system or the background light system is provided in the form of a lamp crosshead disposed at least approximately parallel with the press beams.

In the case of another advantageous embodiment of the bending press, the foreground light system or the background light system is integrated in the interior of a stationary machine housing and the latter has at least one light outlet orifice, in particular a light outlet slot. By integrating the foreground light system and background light system in the interior of the machine housing, they are well protected from accidental damage when manipulating workpieces or during other activities on the bending press, and the light outlet orifice or light outlet slot can be positioned so that the spread of light simultaneously provides good illumination of the working area and low glare for the operator.

The background light system may also incorporate a lamp marker system or be provided in the form of one, in which case the lamp marker system may move a lamp marker by means of a displacement mechanism to one rear stop element of a group of several rear stop elements. If the rear stop system comprises several rear stop elements in different positions, it will be easier for the operator if the rear stop element to be used is readily visible due to a lamp marker without having to look away from the workspace, for example to check on a bending plan which rear stop element should be used.

To this end, the displacement mechanism of the lamp marker system may be connected to the control device controlling the rear stop system in particular, and the lamp marker can be positioned by the displacement mechanism on the respective rear stop element to be used as determined by the control device. This is of particular advantage if several rear stop elements have to be used in a bending sequence for complicated bending sequences. In this respect, the displacement mechanism of the lamp marker system advantageously has a stepper motor which is able to position the lamp marker exactly based on control signals from the control device.

The lamp means of the foreground light system or background light system may be selected from a group comprising glow lamps, halogen lamps, fluorescent tubes, xenon lamps, light-emitting diodes or laser lamps, and a laser lamp is particularly suitable as a lamp means for creating the lamp marker.

Another option for providing favorable lighting conditions in the workspace is if the light intensity of the foreground light system or background light system can be varied by means of a lamp means control system. It may contain an electronic circuit by means of which the light intensity of the lamp means can be adjusted, for example, or a switch can be made between different lamp means or groups of lamp means.

The bending press may also incorporate a lamp marker system by means of which a bending line marker lying can be moved into position in the bending plane, in particular on the top face of a workpiece which can be secured between a bending die secured to the bottom press beam and a bending stamp secured to the top press beam. Such a bending line marker makes it easier for the operator when positioning large workpieces in particular.

Another possible embodiment of the bending press which prevents premature tiring of the operator is one where a deposit with a deposit surface is disposed in front of the bottom press beam. This deposit surface may be used on the one hand to place workpieces to be processed or already bent workpieces, measuring or testing apparatus or other objects within direct handling range of an operator, so that the operator does not have to make tiring and possibly unnecessary movements.

In order to adapt to the work sequence or physical traits of the operator, it is of advantage if the deposit can be positioned in different positions relative to the bottom press beam by means of a displacement system and fixing device. In particular, it may be of practical advantage to permit an adjustment in the vertical direction to cater for operators of different body sizes or different workpiece sizes. Since the deposit could be an obstruction during some bending operations, it is also of advantage if the deposit can be moved between an operating position and a non-operating position, and in particular is mounted so that it can be pivoted about an essentially horizontal pivot axis on the bottom press beam of the press table. If necessary, the deposit can simply be folded downwards, thereby freeing up the necessary space for specific bending operations.

In order to provide enough deposit surface for small to medium-sized sheet metal plates or bent workpieces, the deposit surface has a depth of at least 150 mm when oriented in a more or less horizontal operating position. Accordingly, the width of the deposit surface may correspond to the total working width of the bending press. Deposit surfaces of a bigger depth may also have a recess for the upper body of the operator, who would otherwise be at an unergonomically large distance from the working plane of the bending press when working with a deposit surface with a bigger depth.

An elbow rest may also be provided in front of the bottom press beam, in particular on the deposit, by means of which the operator's upper arms and shoulders are relieved of load when working at the bending press. The elbow rest is advantageously upholstered in order to avoid pressure points on the elbows or lower arms, for example with a foam plastic.

An ergonomically conducive height of the deposit surface is obtained if it is disposed in an operating position of between 0 mm and 150 mm below the top edge of the bottom press beam. As mentioned above, this height can be adjusted by means of an adjusting device.

Another user-friendly design of the bending press is one where a control panel co-operating with the control device of the bending press is disposed on the control side on the stationary machine housing above the top press beam. The height is selected so that control elements disposed on the control panel and optionally a monitor, if one is provided, are disposed at the operator's eye level or slightly above it.

To enable an adjustment to the physical traits of the operator, the control panel is mounted so that it can be positioned in different positions relative to the machine housing by means of a displacement mechanism; in particular, the control panel can be pivoted by the adjusting device about an essentially horizontal pivot axis. The control elements and a monitor can therefore be optimally adjusted to an operator seated or standing on the control side.

BRIEF DESCRIPTION OF THE DRAWINGS

The invention will be explained in more detail below with reference to examples of embodiments illustrated in the appended drawings.

The simplified, schematic diagrams illustrate the following.

DETAILED DESCRIPTION

Figure 1:
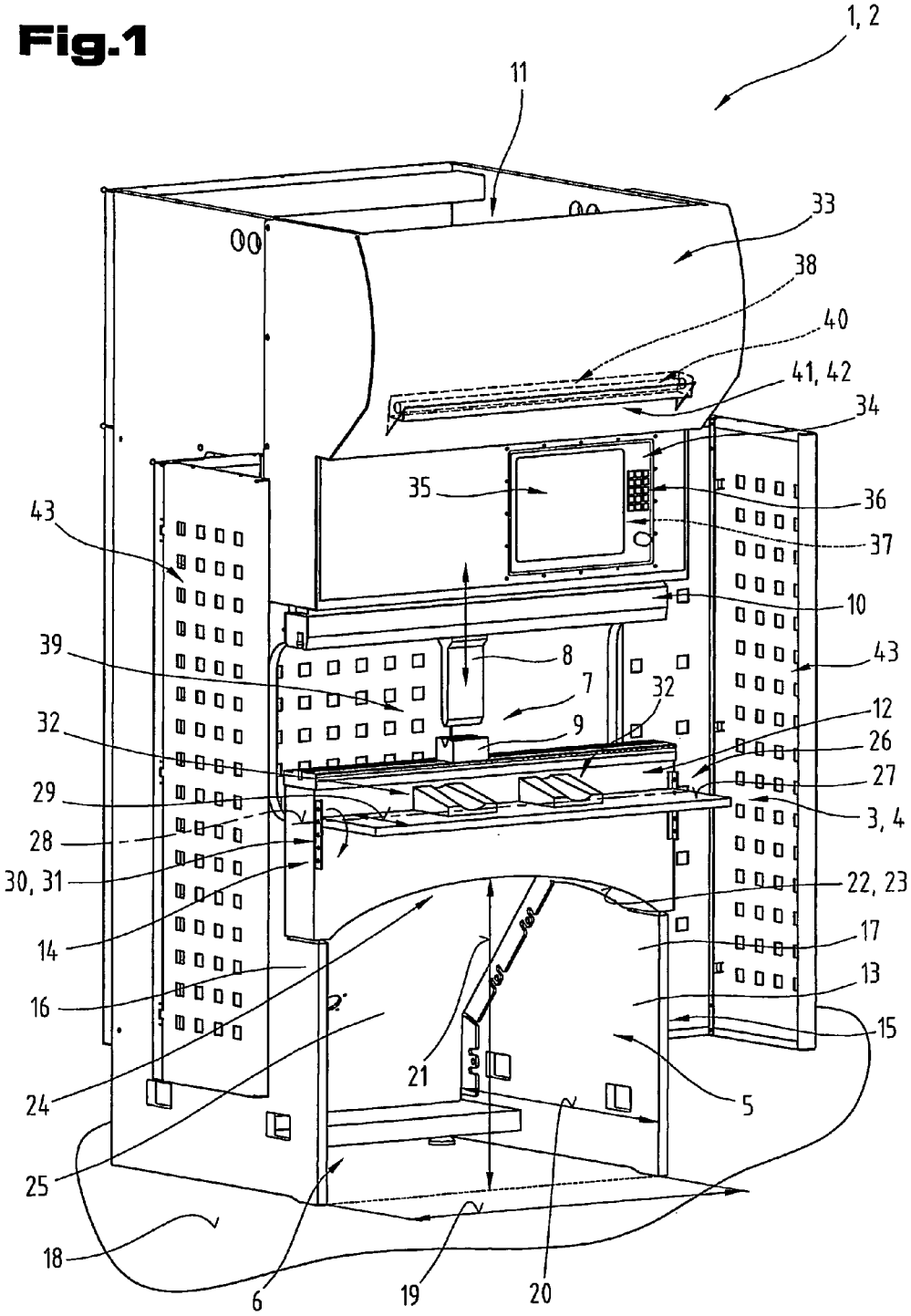
FIG. 1 is a perspective diagram of a bending press proposed by the invention seen from the operating side.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc., relate to the drawing specifically being described and can be transposed in terms of meaning to a new position when another position is being described. Individual features or combinations of features from the different embodiments illustrated and described may be construed as independent inventive solutions or solutions proposed by the invention in their own right.

All the figures relating to ranges of values in the description should be construed as meaning that they include any and all part-ranges, in which case, for example, the range of 1 to 10 should be understood as including all part-ranges starting from the lower limit of 1 to the upper limit of 10, i.e. all part-ranges starting with a lower limit of 1 or more and ending with an upper limit of 10 or less, e.g. 1 to 1.7, or 3.2 to 8.1 or 5.5 to 10.

FIG. 1 is a perspective diagram illustrating a bending press 1 proposed by the invention in the form of a press brake 2 with a recess 5 as proposed by the invention providing foot room 6 for an operator on its control side 3 facing the operator, which also constitutes the front face 4 of the bending press 1.

As is the case with conventional bending presses, the bending press 1 in the form of a press brake 2 has a bending tool 7 comprising a top tool in the form of a bending stamp 8 and a bottom tool in the form of a bending die 9. The bending stamp 8 is mounted on a displaceable top press beam 10, which can be displaced by means of a displacement drive 11, not visible in FIG. 1, relative to a stationary bottom press beam 12 supporting the bending die 9. The bottom press beam 12 is connected to a stable machine frame 13, which constitutes the base structure of the bending press 1. In the embodiment illustrated as an example, the bottom press beam 12 is fixedly mounted on the machine frame 13, being connected to side panels 16, 17 of the machine frame 13 by its end portions 14 and 15. The end portions 14 and 15 are inserted in matching recesses in the panels 16 and 17 and fixedly welded to them.

In the case of another embodiment not illustrated in FIG. 1, the bottom press beam 12 may also be designed as a press table, as is the case with conventional press brakes, which extends down at least approximately as far as a standing surface 18 of the bending press 1. As proposed by the invention, it also has a recess 5 providing foot room 6 in the bending press 1. The bottom press beam 12 may also be mounted on a separate machine table, in which case it also has a recess 5 as proposed by the invention, or foot room 6 disposed in the interior of the machine frame is accessible from it. In order to provide sufficient foot room 6 for the legs of an operator seated at the front edge of the press, the recess 5 has a horizontal internal width 19 of at least 500 mm, and in the embodiment illustrated as an example of approximately 900 mm, a horizontal depth 20 in the interior of the machine frame 13 of at least 250 mm, and in the embodiment illustrated as an example rising from 450 mm in the top region to approximately 750 mm in the floor region, and a vertical internal height 21 of at least 650 mm, in the embodiment illustrated as an example 750 mm. The recess 5 or foot room 6 accessible from it therefore affords enough room for the two legs or feet of an operator of average build underneath the bottom press beam 12 when in a seated position.

In the embodiment illustrated as an example here, a top delimiting surface 22 of the recess 5 is formed by the bottom face 23 of the bottom press beam 12. The press beam 12 is therefore of the tallest possible vertical height for a given size of the recess 5 and hence also has the highest bending resistance. In addition, the bottom face 23 of the bottom press beam 12 and hence also the top delimiting surface 22 of the recess 5 has a cambered rounded region 24, which is designed to disperse the pressing forces transmitted to the bottom press beam 12 during a bending operation into the machine frame 13.

In the embodiment illustrated as an example, the foot room 6 is laterally delimited by the internal faces of the side panels 16, 17 of the machine frame 13; the boundary to the rear and at the top is formed by a foot room guard plate 25 adjoining the bottom face 23 of the bottom press beam 12, which protects the feet and legs of an operator seated at the bending press 1 from any objects which might inadvertently drop behind the bottom press beam 12, such as workpieces or tools for example, and simultaneously helps to increase the stiffness of the machine frame 13.

FIG. 1 also illustrates a deposit 26 attached to the bottom press beam 12, which provides the operator with a deposit surface 27 for depositing workpieces which have been bent or have to be bent, tools or other objects. The deposit 26 can be pivoted from an operating position illustrated in FIG. 1 with an approximately horizontal deposit surface 27 about a horizontal pivot axis 28 down in to a non-operating position, in order to make more bending room available in front of the bottom press beam for specific bending operations. In the horizontal operating position, the deposit surface 27 has a depth 29 of at least 150 mm, preferably 250 mm, oriented transversely to the bottom press beam 12. The deposit 26 can also be positioned and secured in different positions of the bottom press beam 12 by means of a displacement system 30 and a fixing device 31, thereby enabling an adjustment to cater for the physical traits or preferences of the operator, amongst other things. In the case of the embodiment illustrated as an example, a vertical adjustment may be made to the deposit 26, although it would also be conceivable to make provision for a horizontal adjustment by providing appropriate guides. In order to relieve the operator's upper arms and shoulders, elbow rests 32 are also provided on the deposit surface 27, which are upholstered with an elastically flexible foam plastic to provide comfortable support for the lower arms, thereby also reducing the fatigue of the operator.

The displacement drive 11 and the major part of the top press beam 10 is covered by means of a stationary machine housing 33 in the raised non-operating position, which protects the operator from moving parts of the displacement drive 11 on the one hand and on the other makes room for integrating other machine components.

A control panel 34 is integrated in the machine housing 33 approximately at the eye level of an operator standing or seated in front of the bending press 1, which includes a display screen 35 as well as several control elements 36 in the embodiment illustrated as an example here. The control panel 34 is connected to a control device 37, by means of which the functions of the bending press 1 or press brake 2 are controlled. Since the control panel 34 is disposed directly in the range of vision or reach of an operator disposed in front of the bending press 1, the control device 37 can be operated without the operator having to perform additional tiring movements, thereby enabling production efficiency to be increased. Although not illustrated in FIG. 1, an adjusting device is provided, by means of which the control panel can be adjusted about an essentially horizontal pivot axis to provide optimum adjustment for the particular operator.

FIG. 1 also illustrates a foreground light system 38, which is also integrated in the machine housing 33 and illuminates the front workspace 39 in the region of the bending tools 7. This efficient illumination of the central work area makes it easier to see the workpiece and tools, thereby also reducing fatigue of the operator.

The foreground light system 38 comprises one or more lamp means 40, for example a fluorescent tube, light-emitting diodes, glow lamps or some other lamp means, by means of which the working area can be illuminated adequately and as uniformly as possible, and the light from the latter is emitted from the machine housing via a light outlet orifice 41, for example in the form of a light outlet slot 42. The direction in which the light is irradiated is selected so that a user standing or seated in front of the bending press 1 is not subjected to glare in a normal body stance. The light intensity of the foreground light system 38 may be varied by means of a lamp means control system, although this is not illustrated. To provide uniform illumination for the front workspace 39 extending across the total possible working width of the bending press 1, the lamp means 40 may specifically be designed as a lamp crosshead extending parallel with the press beam 10, 12.

FIG. 1 also illustrates two protective screens 43, which prevent anyone approaching the danger region of the bending press 1 from the sides.

Figure 2:
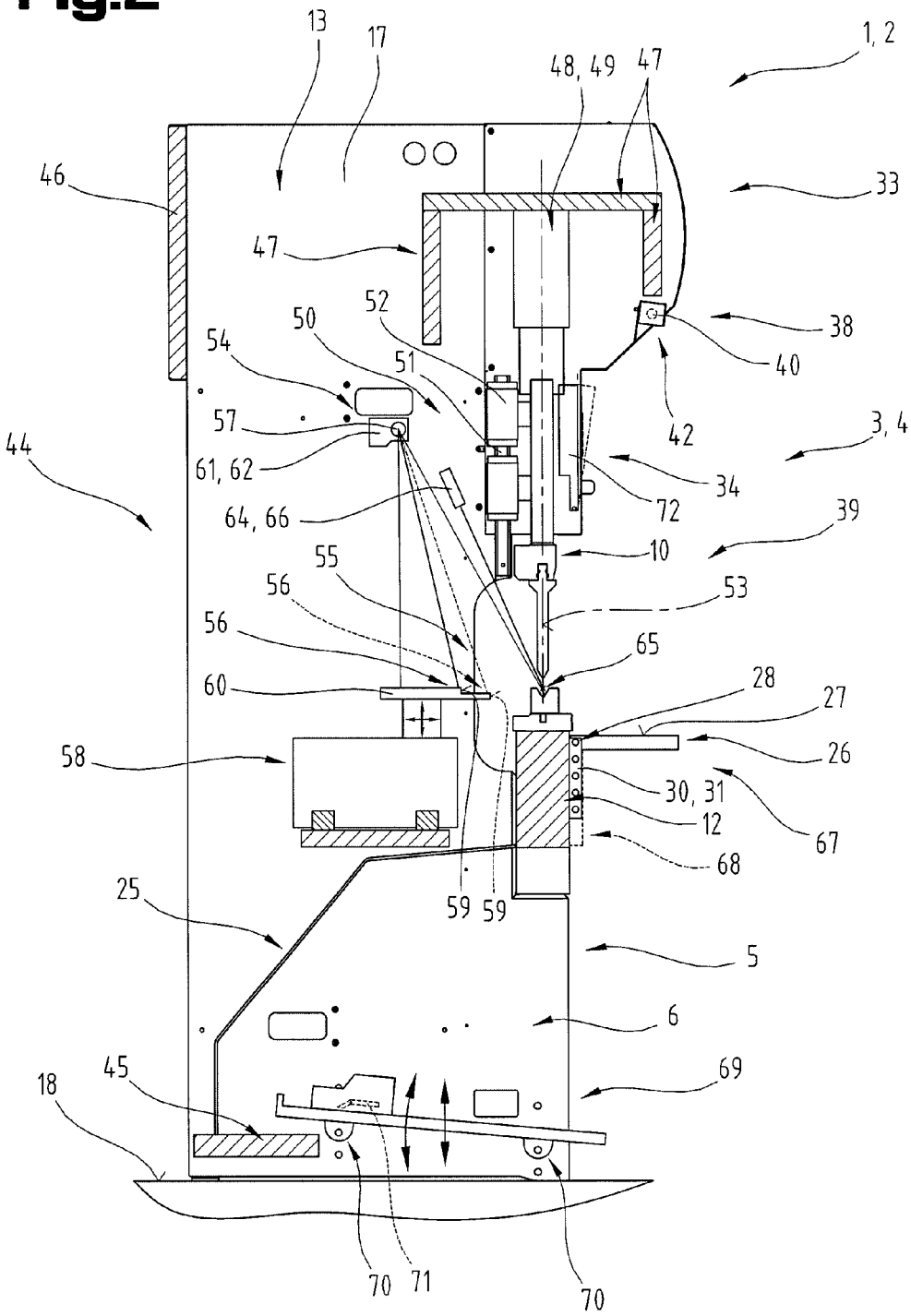
FIG. 2 is a vertical section through a bending press illustrated in FIG. 1.

FIG. 2 illustrates a section through a bending press 1 or press brake 2 based on the embodiment illustrated in FIG. 1, and the section runs from the control side 3 constituting the front face 4 of the bending press 1 to a rear face 44 of the bending press 1. The machine frame 13 essentially comprises the side panels 16, 17 connected by several cross-members and the bottom press beam 12, thereby imparting a high degree of stiffness to the machine frame 13. A bottom cross-member 45 is disposed in the region of the standing surface 18 for example, a top cross-member 46 of the rear face 44 is disposed at the top region of the rear face 44, and there are several inner cross-members 47. In the embodiment illustrated as an example, the cross-members 45, 46, 47 are of a plate-shaped design and can be joined to the side panels 16, 17 by longitudinal weld seams. Of the plate-shaped inner cross-members 47, two extend approximately in the vertical direction and one extends approximately in the horizontal direction, and a drive system 48 of the displacement drive 11 acting on the top press beam 10 is mounted on the latter, for example in the form of a hydraulic cylinder 49. The drive system 48, in this instance in the form of a hydraulic cylinder 49, is therefore supported on the stationary horizontal inner cross-member 47, and a moving drive element of the drive system 48 is connected to the top press beam 10. The displacement drive 11 for the top press beam 10 also has a guide arrangement 50 with a stationary guide track on the machine frame 13, in this instance in the form of two guide rails 51 secured to the side panels 16, 17 and connected to the top press beam 10, and guide elements which can be displaced along the guide track, in this instance in the form of guide carriages 52. On the control side 3, the moving parts of the drive system 48 and the major part of the top press beam 10 are covered by the stationary machine housing 33 in the non-operating position.

Integrated in the machine housing 33 is a foreground light system 38 comprising a lamp means 40, for example in the form of a fluorescent tube, one or more glow lamps or light-emitting diodes for illuminating the front workspace 39, which lies essentially in front of the bending plane 53 extending between the bottom press beam 12 and top press beam 10. Since the lamp means is disposed in the interior of the machine housing 33, a light outlet orifice 41 is provided, in this case in the form of a light outlet slot 42. The light outlet orifice 41 is disposed so that an operator seated or standing in front of the bending press 1 is not subjected to glare; to this end, the light outlet orifice 41 may also be adjusted by means of a light stop. The good lighting of the bending region afforded by the foreground light system 38 improves the visual perception of the operator and helps to delay the onset of fatigue. Behind the bending plane 53 as viewed by the operator is a background light system 54, which illuminates the rear workspace 55. Accordingly, the rear workspace 55 can be uniformly illuminated like the front workspace 39 for example, but the background light system 54 may be designed so that it only causes a linear or spot-shaped lamp marker 56 on an object disposed in the rear workspace 55. To this end, a slim strip of light or a fan beam or light beam is emitted into the rear workspace 55 by a lamp means 57 itself or by a light stop connected downstream of the lamp means 57. The lamp marker 56 may be used to generate a non-physical, visual abutment line for a workpiece to be bent or to mark a stop element 59 disposed on a rear stop system 58 to enable a workpiece to be exactly positioned. It is of particular assistance to the operator if two or more stop elements 59 are provided on the rear stop system 58, in which case the operator will be able to tell solely from the lamp marker 56 which of the stop elements 59 he must use for the bending operation. For example, on a stop finger 60 of the rear stop system 58 with two stop edges lying one behind the other, the lamp marker 56 will be directed onto whichever stop edge is the correct one. Since the stop elements 59 or a stop finger 60 can be moved anywhere in the rear workspace 55 on the basis of numerically controlled axes, the lamp marker 56 is also of a displaceable design and the lamp means 57 or a light stop can also be moved by means of a displacement mechanism 61, for example in the form of a stepper motor 62. For example, a lamp means 57 in the form of a lamp crosshead extending across essentially the entire working width of the bending press 1 is mounted so that it can be pivoted about its longitudinal axis and driven by the stepper motor 62, so that a linear lamp marker 56 can be directed to the requisite position. The lamp means 57 may also be provided in the form of a line laser, for example, which likewise generates a readily visible linear lamp marker in the rear workspace 55. The lamp means 57 and the displacement mechanism 61 together form a lamp marker system 63 which is connected so that it communicates with a control device controlling the rear stop system 58, which will be described in more detail below.

In addition to the foreground light system 38 and background light system 54 described above, the bending press may be provided with another lamp marker system 64, by means of which a bending line marker 65 lying in the bending plane 53 can be directed onto the top face of a workpiece positioned between the bending die 9 and bending stamp 8. As a result, the operator can already see where the bending edge on the workpiece will be before the bending operation. The lamp marker system 64 may be provided in the form of a line laser 66 in particular, which, as illustrated in FIG. 2, may be disposed in the region of the background light system 54, although it is of advantage to dispose the lamp marker system 64 to the side of the press beam 10, 12, in which case a flat fan beam emitted by the lamp marker system 64 can coincide with the bending plane 53 and differences in the thickness of the workpieces to be bent will cause a shift of the bending line marker 65 transversely to the bending plane 53 as would be the case if the fan beam were disposed at an angle to the bending plane 53.

It is recommendable to use bright daylight white illumination for the foreground light system and background light system, although it may also be of advantage to use differently colored light for specific colors of workpieces.

FIG. 2 also illustrates the deposit 26 in front of the bottom press beam 12 in the operating position 67, in which the deposit surface 27 extends more or less horizontally. Due to the pivot axis 28, the deposit 26 can be moved into the non-operating position 68 indicated by broken lines.

Disposed underneath the bottom press beam 12 is the foot room 6 or a recess 5 for an operator seated in front of the bending press 1, which is delimited to the rear of the bottom press beam by the foot room guard plate 25. A foot rest 69 is disposed in the recess 5 or foot room 6 of the embodiment illustrated in FIG. 2, on which an operator seated in front of the bending press 1 can support his feet and legs. The foot rest 69 may be height-adjustable by means of an adjusting device 70 in order to adapt to physical size and may also be adjustable in terms of its inclination. As illustrated, the adjusting device may comprise a plurality of mutually spaced apart fixing points for the foot rest 69, although it would also be possible to provide guide arrangements such as guide rails. In order to operate the bending press 1 from a seated position, a foot switch 71 which can be operated by the foot is disposed in the recess 5 or foot room 6, in particular on the foot rest 69.

The functions of the bending press 1, in particular control of the displacement drive 11, drive system 48, foreground light system 38, background light system 54, rear stop system 58, displacement mechanism 61 and lamp marker systems 63, 64, are operated via a programmable electronic control device 37, which is disposed in the machine housing 33 in the region of the top press beam 10 in the embodiment illustrated as an example here. The control device 37 is provided with the requisite computer units, memory units, input and output interfaces in order to control the machine, in a manner long known from the prior art. In addition to the foot switch 71, the control panel 34 described in connection with FIG. 1 is provided approximately on a level with the eyes of the operator to enable him to operate the control device 37. In order to adapt to operators of different body sizes, its inclination can be adjusted about a horizontal pivot axis 72 as indicated by broken lines.

Figure 3:
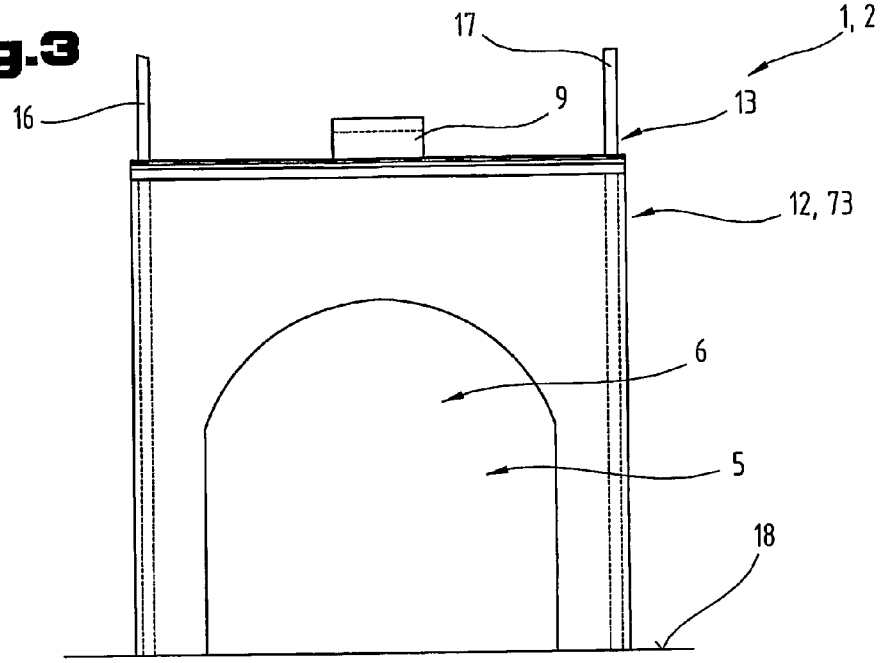
FIG. 3 is a partial view of another embodiment of a bending press proposed by the invention.

FIG. 3 illustrates the bottom part of a control side of a bending press 1 or press brake 2 proposed by the invention, where the bottom press beam 12 is designed as a press table 73 based on a known design of press brake extending down as far as the region of the standing surface 18 but with a recess 5 affording foot room 6. The press table 73 may be joined to the two panels 16, 17 of the machine frame 13 by means of weld seams across its entire height.

Figure 4:
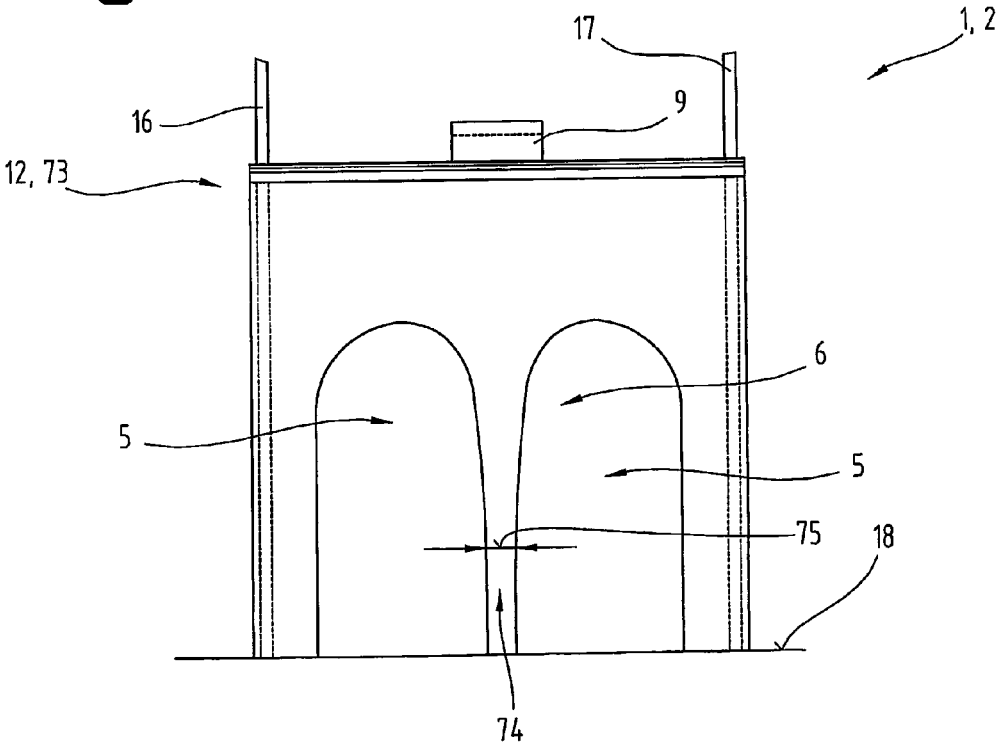
FIG. 4 is a partial view of another embodiment of a bending press proposed by the invention.

FIG. 4 illustrates the bottom part of the control side of another embodiment of a bending press 1 or press brake 2, in which two recesses 5 are disposed adjacent to one another in a press table 73 affording foot room 6 for an operator seated in front of the bending press 1. The two recesses 5 are separated from one another by a support element 74 which is supported on the standing surface 18 or on a bottom part of the machine frame 13. As a result of the support element 74 disposed in the region of the highest bending moment, the lower stiffness of the press table 73 or bottom press beam 12 due to the recesses 5 has only a very slight effect.

The embodiments illustrated as examples represent possible variants of the bending press, and it should be pointed out at this stage that the invention is not specifically limited to the variants specifically illustrated, and instead the individual variants may be used in different combinations with one another and these possible variations lie within the reach of the person skilled in this technical field given the disclosed technical teaching. Accordingly, all conceivable variants which can be obtained by combining individual details of the variants described and illustrated are possible and fall within the scope of the invention.

For the sake of good order, finally, it should be pointed out that, in order to provide a clearer understanding of the structure of the bending press, it and its constituent parts are illustrated to a certain extent out of scale and/or on an enlarged scale and/or on a reduced scale.

The objective underlying the independent inventive solutions may be found in the description.

Above all, the individual embodiments of the subject matter illustrated in FIGS. 1; 2; 3; 4 constitute independent solutions proposed by the invention in their own right. The objectives and associated solutions proposed by the invention may be found in the detailed descriptions of these drawings.

| List of reference numbers | |
|---|---|
| 1 | Bending press |
| 2 | Press brake |
| 3 | Control side |
| 4 | Front face |
| 5 | Recess |
| 6 | Foot room |
| 7 | Bending tool |
| 8 | Bending stamp |
| 9 | Bending die |
| 10 | Top press beam |
| 11 | Displacement drive |
| 12 | Bottom press beam |
| 13 | Machine frame |
| 14 | End portion |
| 15 | End portion |
| 16 | Panel |

-continued

| List of reference numbers | |
|---|---|
| 17 | Panel |
| 18 | Standing surface |
| 19 | Width |
| 20 | Depth |
| 21 | Height |
| 22 | Delimiting surface |
| 23 | Bottom face |
| 24 | Rounded region |
| 25 | Foot room guard plate |
| 26 | Deposit |
| 27 | Deposit surface |
| 28 | Pivot axis |
| 29 | Depth |
| 30 | Displacement system |
| 31 | Fixing device |
| 32 | Elbow rest |
| 33 | Machine housing |
| 34 | Control panel |
| 35 | Display screen |
| 36 | Control element |
| 37 | Control device |
| 38 | Foreground light system |
| 39 | Front Workspace |
| 40 | Lamp means |
| 41 | Light outlet orifice |
| 42 | Light outlet slot |
| 43 | Protective screen |
| 44 | Rear face |
| 45 | Bottom cross-member |
| 46 | Top cross-member |
| 47 | Inner cross-member |
| 48 | Drive system |
| 49 | Hydraulic cylinder |
| 50 | Guide arrangement |
| 51 | Guide rails |
| 52 | Guide carriage |
| 53 | Bending plane |
| 54 | Background light system |
| 55 | Rear Workspace |
| 56 | Lamp marker |
| 57 | Lamp means |
| 58 | Rear stop system |
| 59 | Stop element |
| 60 | Stop finger |
| 61 | Displacement mechanism |
| 62 | Stepper motor |
| 63 | Lamp marker system |
| 64 | Lamp marker system |
| 65 | Bending line marker |
| 66 | Line laser |
| 67 | Operating position |
| 68 | Non-operating position |
| 69 | Foot rest |
| 70 | Adjusting device |
| 71 | Foot switch |
| 72 | Pivot axis |
| 73 | Press table |
| 74 | Support element |
| 75 | Width |

The invention claimed is:

1. A bending press comprising a stationary bottom press beam and a top press beam which can be displaced relative to the bottom press beam by a displacement drive, a bending stamp mounted on the top beam press and a cooperating bending die mounted on the bottom press beam, and at least one recess below or in the bottom press beam on a control side of the bending press affording room for an operator's feet, wherein a foot rest higher than a standing surface of the bending press and height-adjustable is disposed in the recess, and a deposit with a deposit surface is disposed on the control side in front of the bottom press beam which can be positioned in different positions relative to the bottom press beam by a displacement system and a fixing device, wherein the deposit can be displaced between an operating position and a non-operating position, and is mounted on the bottom press beam so that it can be pivoted about an essentially horizontal pivot axis.

2. The bending press according to claim 1, wherein the recess has a horizontal internal width of at least 750 mm.

3. The bending press according to claim 1, wherein two mutually spaced apart recesses are provided, each with a horizontal internal width of at least 200 mm, and a support element with a width of between 50 mm and 250 mm is disposed between the two recesses.

4. The bending press according to claim 1, wherein the recess has a horizontal depth of at least 450 mm as measured from the front face of the bending press.

5. The bending press according to claim 1, wherein the recess extends at least 200 mm behind a bending plane formed by the press beam.

6. The bending press according to claim 1, wherein the recess has a vertical internal height of at least 650 mm in the middle.

7. The bending press according to claim 1, wherein a top delimiting surface of the recess has a cambered rounded region.

8. The bending press according to claim 1, wherein a top delimiting surface of the recess is formed by the bottom face of the bottom press beam.

9. The bending press according to claim 1, comprising a machine frame having side panels wherein the bottom press beam is secured to the side panels of the machine frame.

10. The bending press according to claim 1, wherein the inclination of the foot rest can be adjusted.

11. The bending press according to claim 1, wherein a foot switch, which is connected to a control device of the bending press and can be operated by the feet, is disposed in the recess.

12. The bending press according to claim 1, wherein an illuminating foreground light system comprising a lamp means is disposed in front of the bending plane in the front workspace between the top press beam and bottom press beam.

13. The bending press according to claim 12, wherein an illuminating background light system comprising a lamp means is disposed behind the bending plane in the rear workspace behind the bottom press beam on a rear stop system.

14. The bending press according to claim 13, wherein the foreground light system or background light system is formed by a lamp crosshead disposed at least approximately parallel with the press beams.

15. The bending press according to claim 13, wherein the lamp means of the foreground light system or background light system is integrated in the interior of a stationary machine housing and has at least one light outlet orifice, in particular a light outlet slot.

16. A bending press comprising a stationary bottom press beam and a top press beam which can be displaced relative to the bottom press beam, a bending stamp mounted on the top beam press and a cooperating bending die mounted on the bottom press beam, at least one recess below or in the bottom press beam on a control side of the bending press affording room for an operator's feet, wherein a foot rest higher than a standing surface of the bending press and height-adjustable is disposed in the recess, and a deposit with a deposit surface is disposed on the control side in front of the bottom press beam which can be positioned in different positions relative to the bottom press beam, wherein an illuminating foreground light system comprising a lamp means is disposed in front of the bending plane in the front workspace between the top press beam and bottom press beam, wherein an illuminating background light system comprising a lamp means is disposed behind the bending plane in the rear workspace behind the bottom press beam on a rear stop system, and wherein the background light system comprises a lamp marker system, which can direct a lamp marker caused by the lamp means by a displacement mechanism towards one stop element of a group of several stop elements.

17. The bending press according to claim 16, wherein the displacement mechanism of the lamp marker system is connected so as to communicate with the control device controlling the rear stop system and the lamp marker can be positioned by the displacement mechanism on whichever stop element should be used as determined by the control device.

18. The bending press according to claim 17, wherein the displacement mechanism comprises a stepper motor.

19. The bending press according to claim 16, wherein the lamp means of the foreground light system or background light system is selected from the group consisting of glow lamps, halogen lamps, fluorescent tubes, xenon lamps, light-emitting diodes, and laser lamps.

20. The bending press according to claim 16, wherein the light intensity of the foreground light system or background light system can be varied by means of a lamp means control system.

21. The bending press according to claim 1, wherein the bending press has a lamp marker system by means of which a bending line marker lying in the bending plane formed by the press beam can be directed onto the top face of a workpiece positioned between a bending die secured to the bottom press beam and a bending stamp secured to the top press beam.

22. The bending press according to claim 1, characterized in that the deposit surface has a depth of at least 150 mm oriented transversely to the bottom press beam in an approximately horizontal operating position.

23. The bending press according to claim 1, wherein an elbow rest is disposed in front of the bottom press beam, on the deposit.

24. The bending press according to claim 1, wherein the deposit surface is disposed between 0 mm and 150 mm underneath the top edge of the bottom press beam in the operating position.

25. The bending press according to claim 1, wherein a control panel co-operating with a control device of the bending press is disposed on the control side on a stationary machine housing in front of and above the top press beam.

26. The bending press according to claim 25, wherein the control panel can be positioned in different positions relative to the machine housing by an adjusting device.

27. A bending press comprising a stationary bottom press beam and a top press beam which can be displaced relative to the bottom press beam, a bending stamp mounted on the top beam press and a cooperating bending die mounted on the bottom press beam, at least one recess below or in the bottom press beam on a control side of the bending press affording room for an operator's feet, wherein a foot rest higher than a standing surface of the bending press and height-adjustable is disposed in the at least one recess, and a deposit with a deposit surface is disposed on the control side in front of the bottom press beam which can be positioned in different positions relative to the bottom press beam by a displacement system and a fixing device, wherein a control panel co-operating with a control device of the bending press is disposed on the control side on a stationary machine housing in front of and above the top press beam, wherein the control panel can be positioned in different positions relative to the machine housing by an adjusting device, and wherein the control panel can be adjusted about an essentially horizontal pivot axis by the adjusting device.

* * * * *